US006978560B2

(12) United States Patent
Chen et al.

(10) Patent No.: US 6,978,560 B2
(45) Date of Patent: Dec. 27, 2005

(54) SHOE HAVING AN UPPER WITH A WELT-LIKE FOLD LINE

(75) Inventors: Eddie Chen, 9F, No. 201, Sec. 1, Taichung-Kang Rd., Taichung City (TW); Phoenix Hsu, Taichung (TW)

(73) Assignee: Eddie Chen, Taichung (TW)

( * ) Notice: Subject to any disclaimer, the term of this patent is extended or adjusted under 35 U.S.C. 154(b) by 172 days.

(21) Appl. No.: 10/640,094

(22) Filed: Aug. 12, 2003

(65) Prior Publication Data

US 2005/0034325 A1 Feb. 17, 2005

(51) Int. Cl.[7] ..... A43B 9/04; A43B 9/06; A43B 15/00

(52) U.S. Cl. ..... 36/78; 36/17 R; 36/17 PW; 36/21; 12/67 K; 12/146 W; 12/142 D

(58) Field of Search ..... 36/78, 17 R, 17 A, 36/17 PW, 21, 45, 18, 19 R; 12/67 C, 67 K, 12/146 W, 142 D, 146 PW

(56) References Cited

U.S. PATENT DOCUMENTS 4,685,223 A * 8/1987 Long ..... 36/19 R
4,777,740 A * 10/1988 Akagi ..... 36/17 R
4,852,275 A * 8/1989 Bianchini et al. ..... 36/17 R
6,484,420 B1 11/2002 Chi et al.
6,810,604 B2 * 11/2004 Chen et al. ..... 36/17 R

* cited by examiner

*Primary Examiner*—Anthony Stashick
(74) *Attorney, Agent, or Firm*—Ladas & Parry LLP

(57) ABSTRACT

A shoe includes an upper with an open bottom portion which is a welt-like fold line unit. The fold line unit is defined by an outward turning part and an inward turning part which are sewn together through a sewing line unit. An interior strip unit is received inside the fold line unit and retained therein by the sewing line unit. An outsole connected to the upper, has a peripheral end with a top face extending proximate to the fold line unit. A insole connected to the upper has an outer edge which is separated and spaced apart from the welt-like fold line unit, whereby no part of the insole is included in the welt-like fold line unit and the fabrication thereof is simplified.

8 Claims, 10 Drawing Sheets

SHOE HAVING AN UPPER WITH A WELT-LIKE FOLD LINE

BACKGROUND OF THE INVENTION

1. Field of the Invention

The invention relates to a shoe, more particularly to a shoe having an upper which is folded to form a welt-like fold line unit.

2. Description of the Related Art

Referring to FIG. 1, a stitchdown shoe of San Crispino construction includes an upper 1, an insole 2, a stitch line 3 and an outsole 4. The bottom end of the upper 1 is turned outward and folded to be lasted over the periphery of the insole 2. The stitch line 3 is provided along the folded part of the upper 1. When the bottom end of the upper 1 is cemented to the top face of the outsole 4, the bottom end of the upper 1 projects outward, presenting an appearance of a stitchdown shoe. Another shoe with a similar construction is suggested in U.S. Pat. No. 6,484,420. The shoe disclosed therein has a configuration which combines the shapes of a stitchdown shoe and a sport shoe. Although the aforesaid shoe constructions have pleasing outer appearances, they have the following drawbacks:

1. The upper 1 must be supported by an insole 2, which is wider than a last used for lasting the upper 1, in order to present a welt-like configuration. Furthermore, a stiff or less softness material is needed to fabricate the insole 2. As a result, the shoe not only has low flexibility at the front region thereof but also is heavy.

2. Since the bottom end of the upper 1 is folded to wrap around the outer edge of the insole 2, the resulting welt-like configuration is limited to a horizontal plane or line which is defined by the outer edge of the insole so that it cannot be varied to match different shoe designs.

3. The insole 2 has to be formed by using a particular mold which increases the production cost of the shoe.

4. Because the bottom end of the upper 1 is used to wrap around the insole 2 to provide the appearance of a welt, only a lasting process can be used to make such a shoe. A strobel stitching process cannot be applied to the shoe.

Referring to FIG. 2, another shoe which has a welted construction includes an upper, a lining 6, an insole 7, a strip 8, a stitch line 3 and an outsole 9. The bottom end of the upper 5 is folded about the bottom end of the lining 6, the outer periphery of the insole 7 and the strip 8. Thereafter, the bottom end of the upper 5 is sewed to the bottom end of the lining 6 and the outer periphery of the insole 7 to present a stitchdown shoe configuration. In this shoe, although the insole 7 may be made of a soft material, the process of making such a shoe is complicated and time-consuming. In addition, since too many components have to be sewn together, the shoe cannot have sufficient flexibility at its front region. Moreover, this shoe can be constructed only by using a strobel stitching process.

SUMMARY OF THE INVENTION

An object of the present invention is to provide a shoe which overcomes the drawbacks encountered by the aforesaid conventional shoes.

Accordingly, the present invention provides a shoe which comprises: an upper having an open top portion and an open bottom portion, the bottom portion having a front toe end and a rear heel end, the bottom portion being folded to form a welt-like fold line unit, the welt-like fold line unit including an outward turning part and an inward turning part; a sewing line unit extending through and fastening the outward and inward turning parts; an interior strip unit extending along the fold line unit, the interior strip unit being received inside the fold line unit and retained therein by the sewing line unit; an outsole connected to the upper, the outsole having a peripheral end which has a top face extending proximate to the fold line unit; and an insole connected to the bottom portion of the upper, the insole having an outer edge which is separated and spaced part from the welt-like fold line unit, whereby no part of the insole is included in the welt-like fold line unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
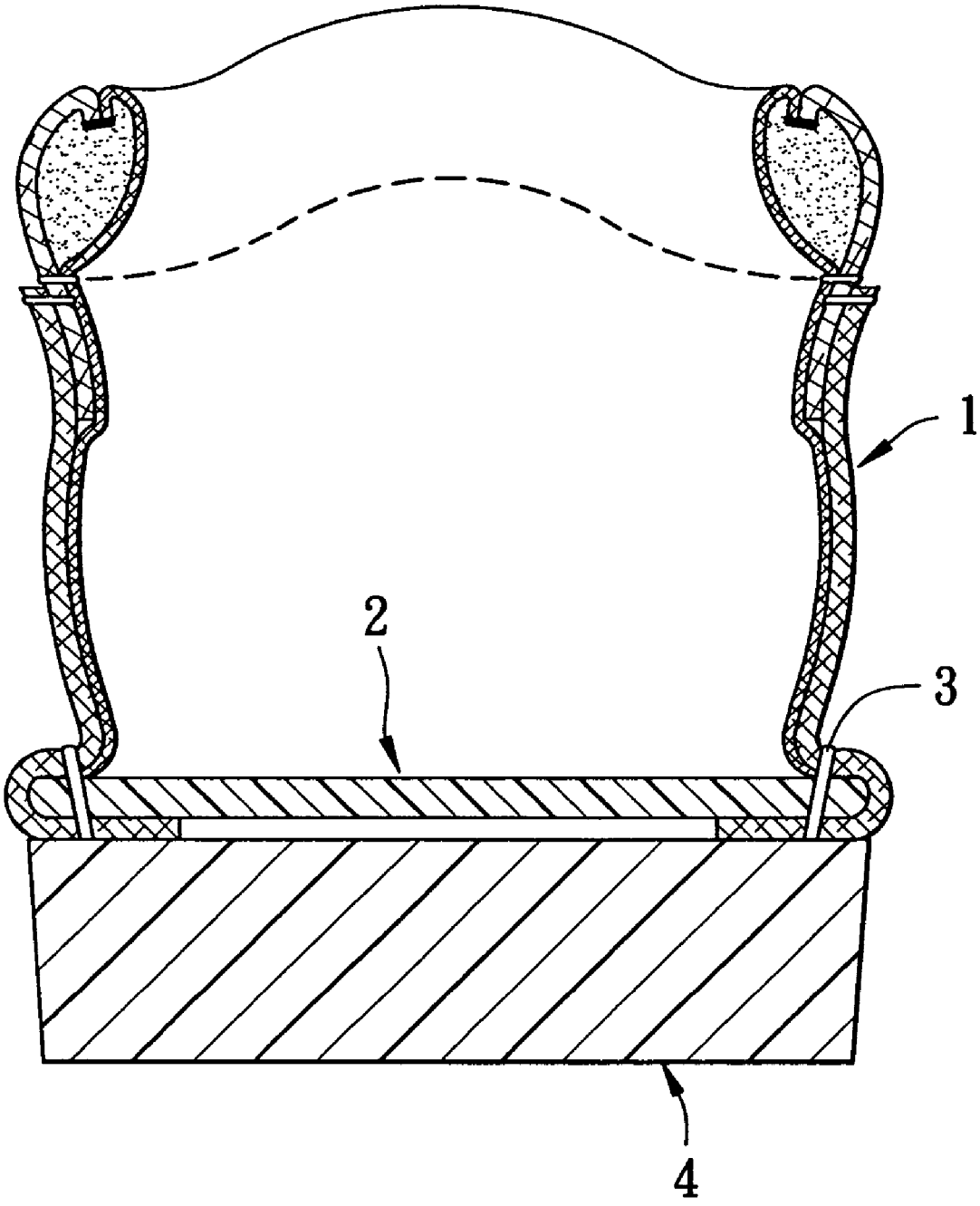
FIG. 1 PRIOR ART
FIG. 1 is a sectional view of a conventional shoe.

The present invention will be illustrated with reference to FIGS. 3 to 10, wherein like elements are represented by like reference numerals.

Figure 3:
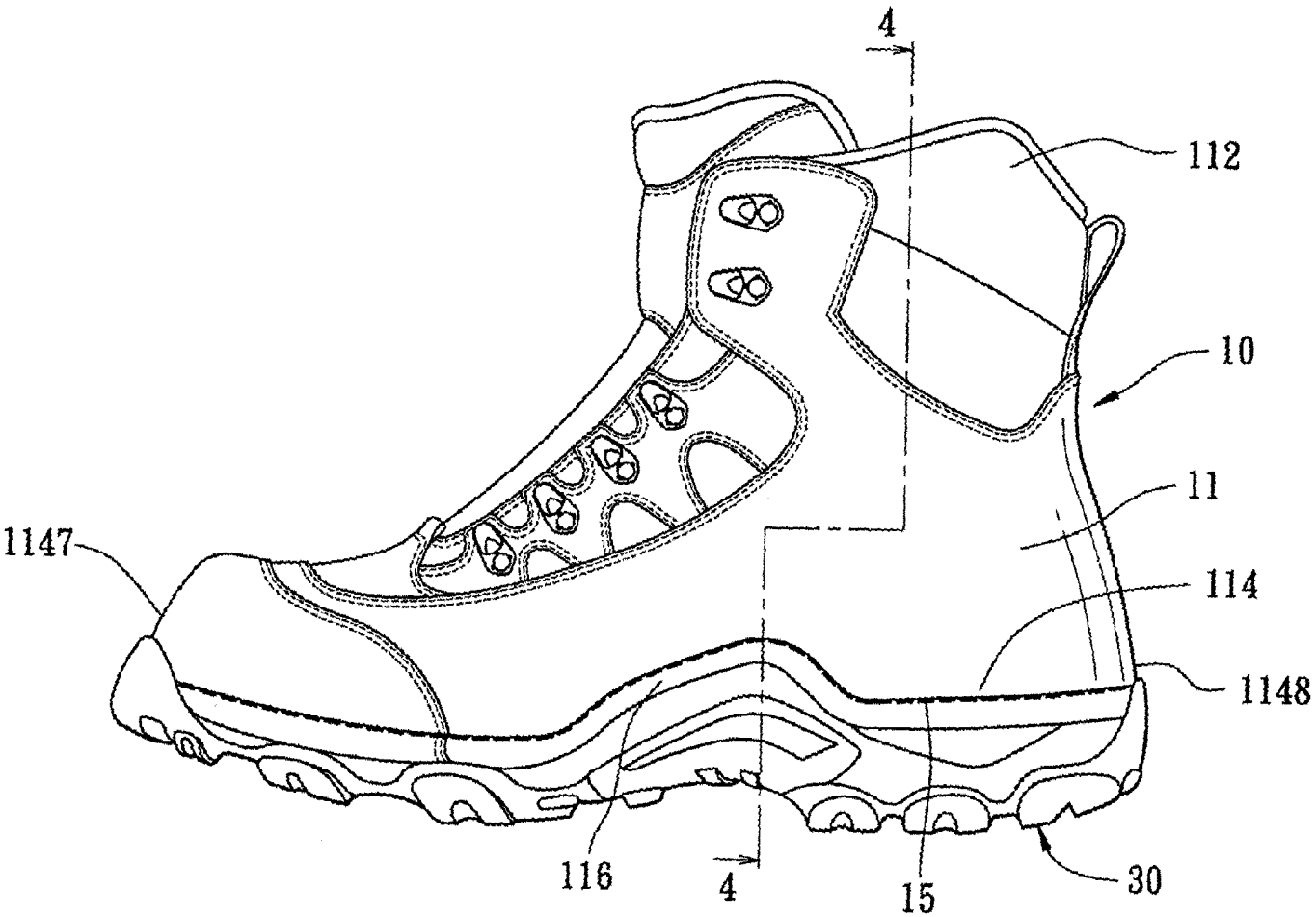
FIG. 3 is a side view of a first preferred embodiment of the present invention.
Figure 4:
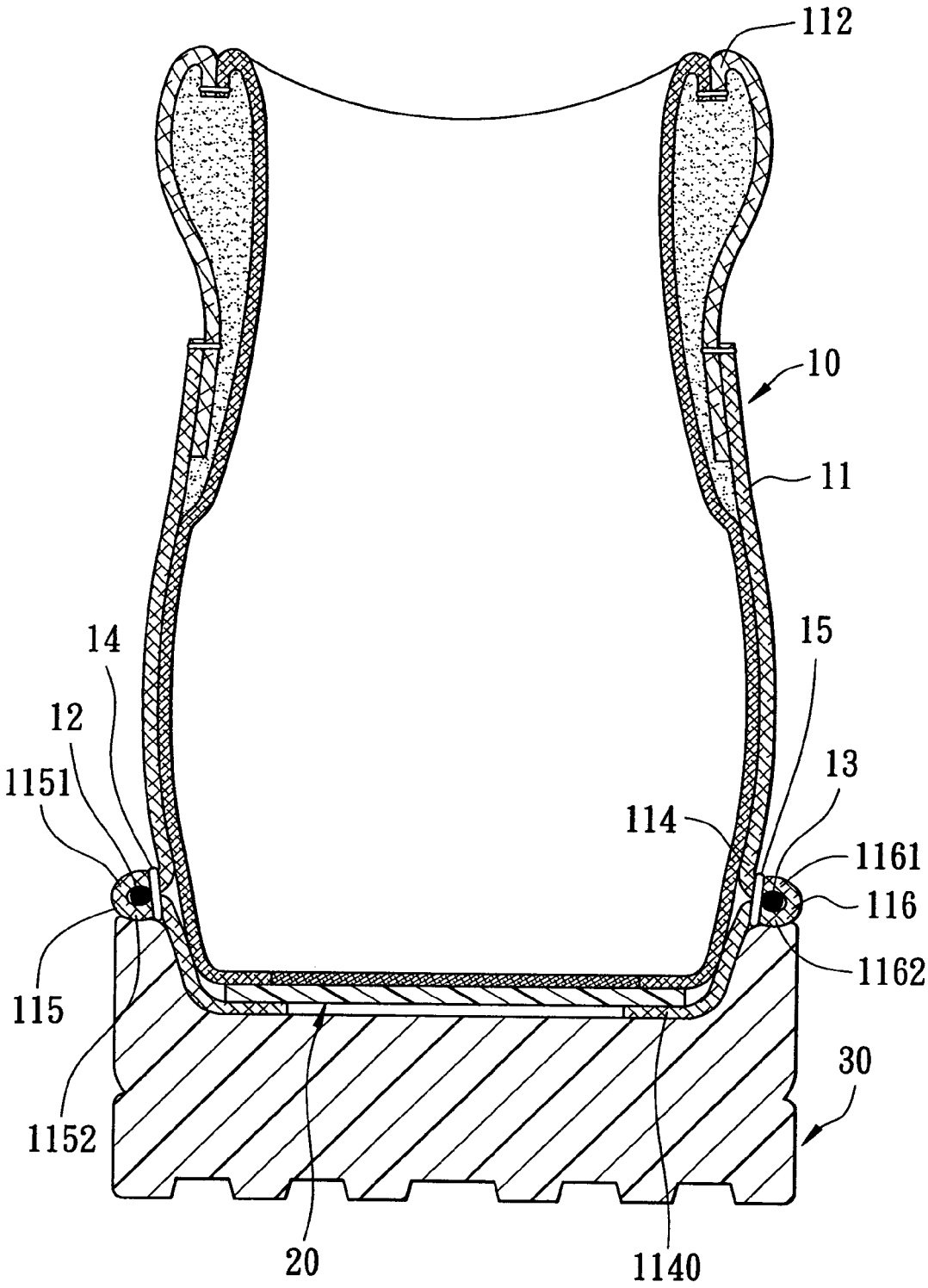
FIG. 4 is a sectional view taken along 4—4 of FIG. 3.

Referring to FIGS. 3 and 4, a first embodiment of the present invention includes a shoe 10 which has an upper 11 connected to an insole 20 and an outsole 30. The upper 11 includes an open top portion 112 and an open bottom portion 114. The open bottom portion 114 is bent inward and lasted over the insole 20.

The bottom portion 114 of the upper 11 is folded at left and right sides thereof to form left and right fold lines 115, 116 which constitute a welt-like fold line unit. In particular, the upper 11 is turned outward and thereafter inward to form the fold lines 115 and 116 which extend from a front toe end 1147 to a rear heel end 1148 of the upper 11 and which are separated from each other at the front toe end 1147 and the rear heel end 1148. Each left or right fold line 115 or 116 has an outward turning part 1151 or 1161 and an inward turning part 1152 or 1162 which are sewn to each other through a sewing line 14 or 15. Two interior strips 12 and 13 are respectively received within the left and right fold lines 115 and 116 and retained therein by the sewing lines 14 and 15. The front toe end 1147 and the rear heel end 1148 of the upper 11 are not folded and have not any interior strip.

Each interior strip 12 or 13 may be configured to have any cross-sectional shape, such as a circle, semicircle rectangle, triangle, etc. The cross sections of the interior strips 12 and 13 may be the same or different. In this embodiment, the cross sections of both interior strips 12, 13 are circular.

To fabricate the shoe 10, the upper 11 is first prepared by providing the left and right fold lines 115, 116 respectively at the left and right sides of the upper 11, and by enclosing the interior strips 12, 13 respectively within the left and right fold lines 115 and 116. Then, the sewing lines 14 and 15 are provided respectively in the left and right fold lines 115 and 116 to prevent the interior strips 12, 13 from being released from the left and right fold lines 115, 116. Thereafter, the bottom portion 114 of the upper 11 is lasted over the insole 20, and the lasted upper 11 is cemented to the outsole 30 so that the left and right fold lines 115, 116 are proximate to and are in abutment with the top face of a peripheral end of the outsole 30. A welt-like configuration is thus formed in the shoe 10.

Note that the bottom portion 114 of the upper 11 has a bottommost end 1140 which is lasted over the insole 20 and that the left and right fold lines 115, 116 are disposed at a level above the bottommost end 1140 and the insole 20. Moreover, the top face of the peripheral end of the outsole 30 is higher than the bottommost end 1140 of the upper 11 so as to contact the fold lines 115, 116.

With the left and right fold lines 115, 116 formed in the bottom portion 114 of the upper 11, the upper 11 can present a shape resembling a welted shoe, like the conventional shoe shown in FIG. 1 in which the upper 1 thereof is folded about the outer edge of the insole 20. However, the upper 11 provides an additional advantage in that the insole 20 can be made of a soft material which is beneficial for the flexing of the shoe 10, especially at the front region thereof. This is because the upper 11 is not folded about the edge of the insole 20. Furthermore, the weight of the shoe 10 in the invention is reduced due to the insole 20 which is soft and small as compared to the insole 20 shown in FIG. 1. Moreover, the insole 20 in the present invention may be constructed in such a manner that the insole 20 is composed of a soft material at its front region to provide flexibility and a stiff material at its rear region to increase supporting strength.

In addition, unlike the conventional shoe in which the shape of the welt-like fold of the upper 1 is limited only to a horizontal line defined by the outer edge of the insole 20, the left and right fold lines 115, 116 of the upper 11 in this invention can have a curved shape as best shown in FIG. 3, or any other suitable shape. This permits the welt configuration of the upper 11 to diversify and to match different shoe designs. Moreover, the welt configuration of the upper 11 can be varied by changing the cross sectional shape of the interior strips 12, 13. On the other hand, the insole 20 in this invention need not be formed by using a mold, thus reducing the production cost thereof.

Figure 2:
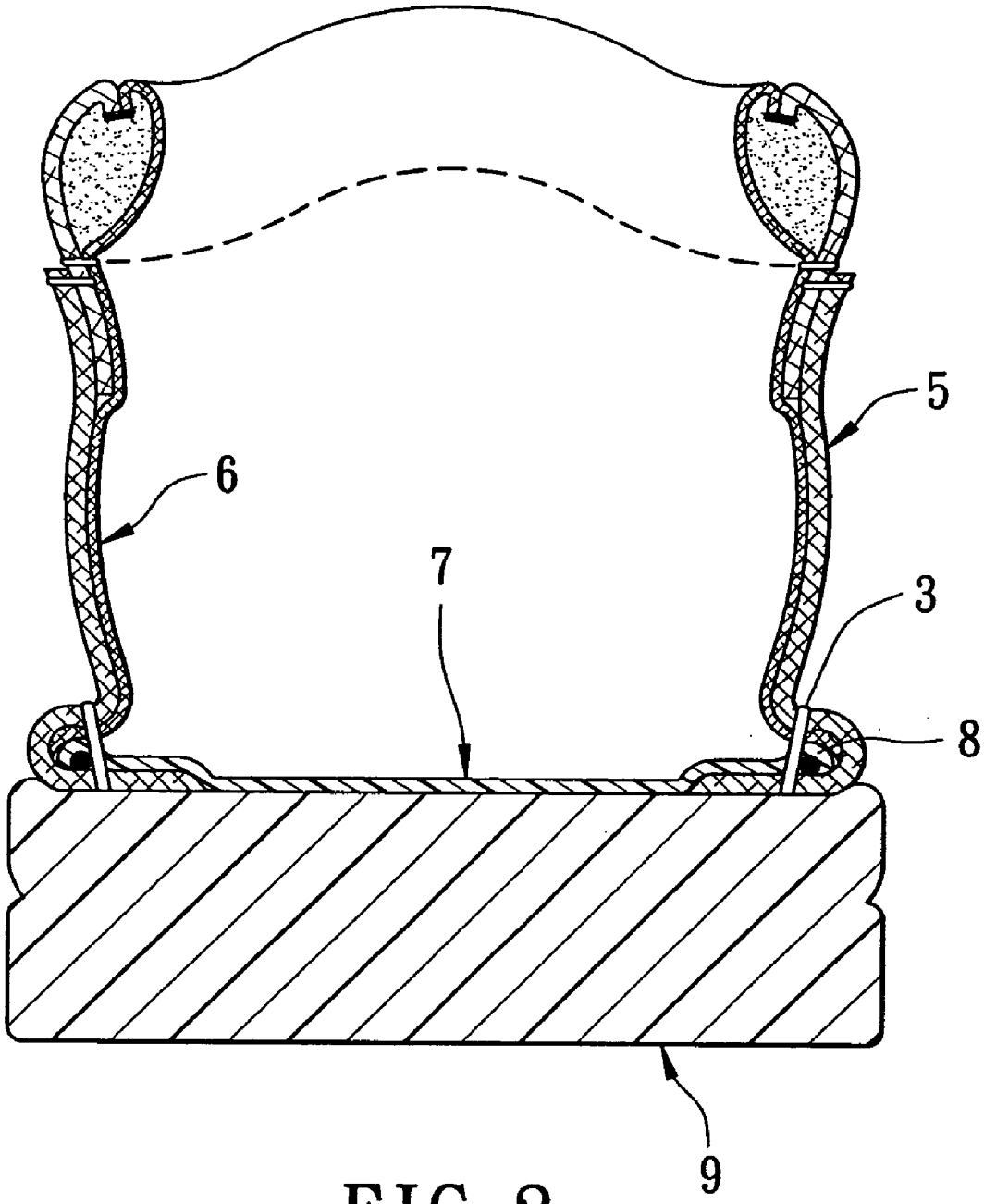
FIG. 2 PRIOR ART
FIG. 2 is a sectional view of another conventional shoe.

Aside from the aforesaid, the shoe 10 can be constructed more easily as compared with the prior art shown in FIG. 2. This is because the outer edge of the insole 20 is separated and spaced apart from the left and right fold lines 115, 116. As such, no part of the insole 20 is included in the fold lines 115, 116.

While the fold line unit in the first embodiment includes separate left and right fold lines 115, 116 receiving respective interior strips 12, 13, the fold line unit should not be limited only thereto. The fold line unit may be a continuous single fold line which receives a continuous single interior strip or two or more separate interior strips, or may be composed of two or more separate fold lines which respectively receive separate interior strips. The interior strips may have different cross-sectional shapes and may have different stiffness properties.

Figure 5:
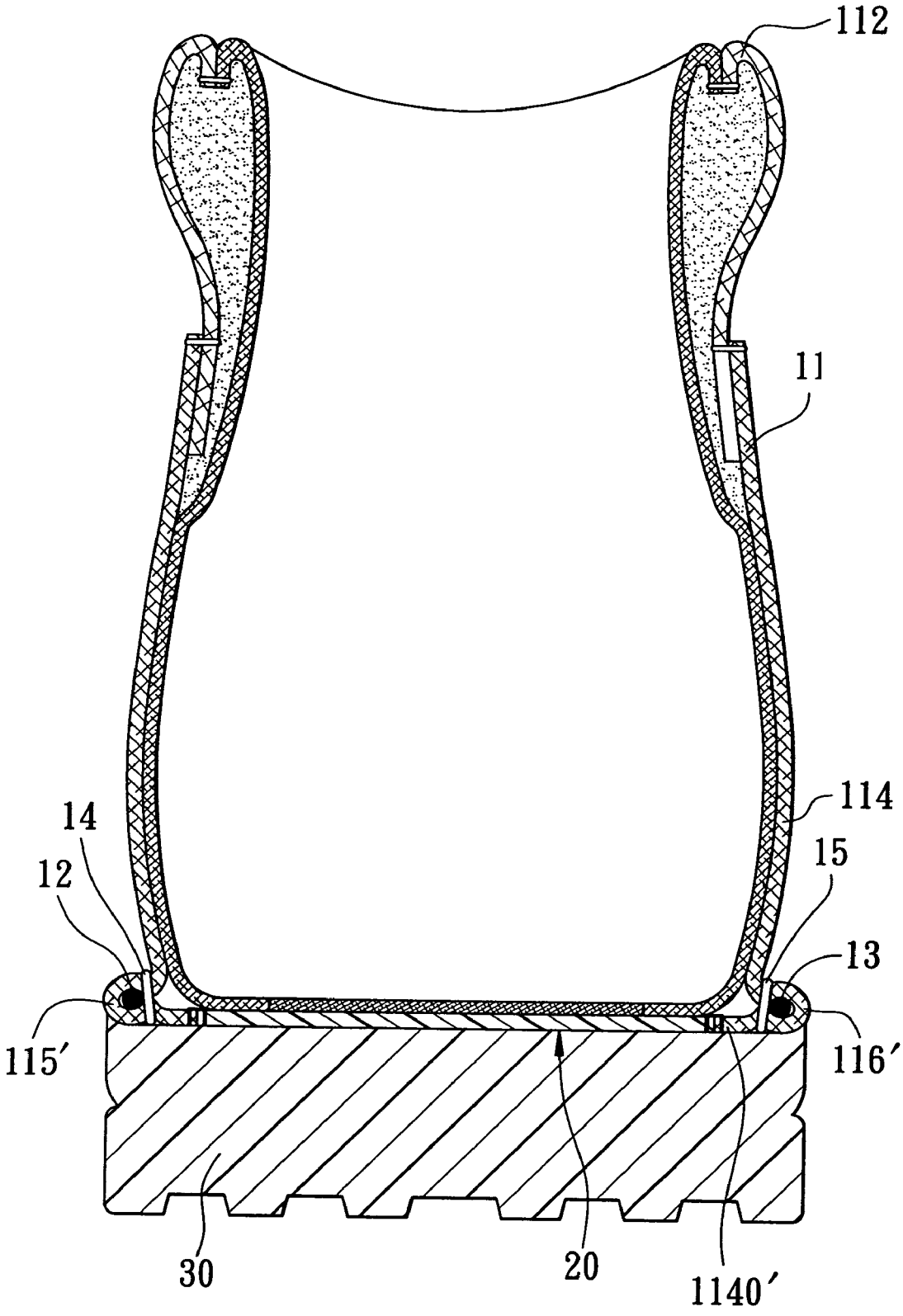
FIG. 5 is a sectional view of a second preferred embodiment of the present invention.

Referring to FIG. 5, a second preferred embodiment of the present invention is substantially similar to the first embodiment except that the bottom portion 114 of the upper 11 in this embodiment is sewn to the peripheral end of the insole 20 through a strobel stitching process. In this embodiment, the bottom portion 114 of the upper 11 has a terminating end 1140' which is sewn directly to the outer edge of the insole 20, and the left and right fold lines 115', 116' are disposed or located outwardly of the terminating end 1140' of the upper 11. Specifically, the bottom portion 114 of the upper 11 extends outwardly a distance from the terminating end 1140' and then folded upward to form the fold lines 115', 116'.

Figure 6:
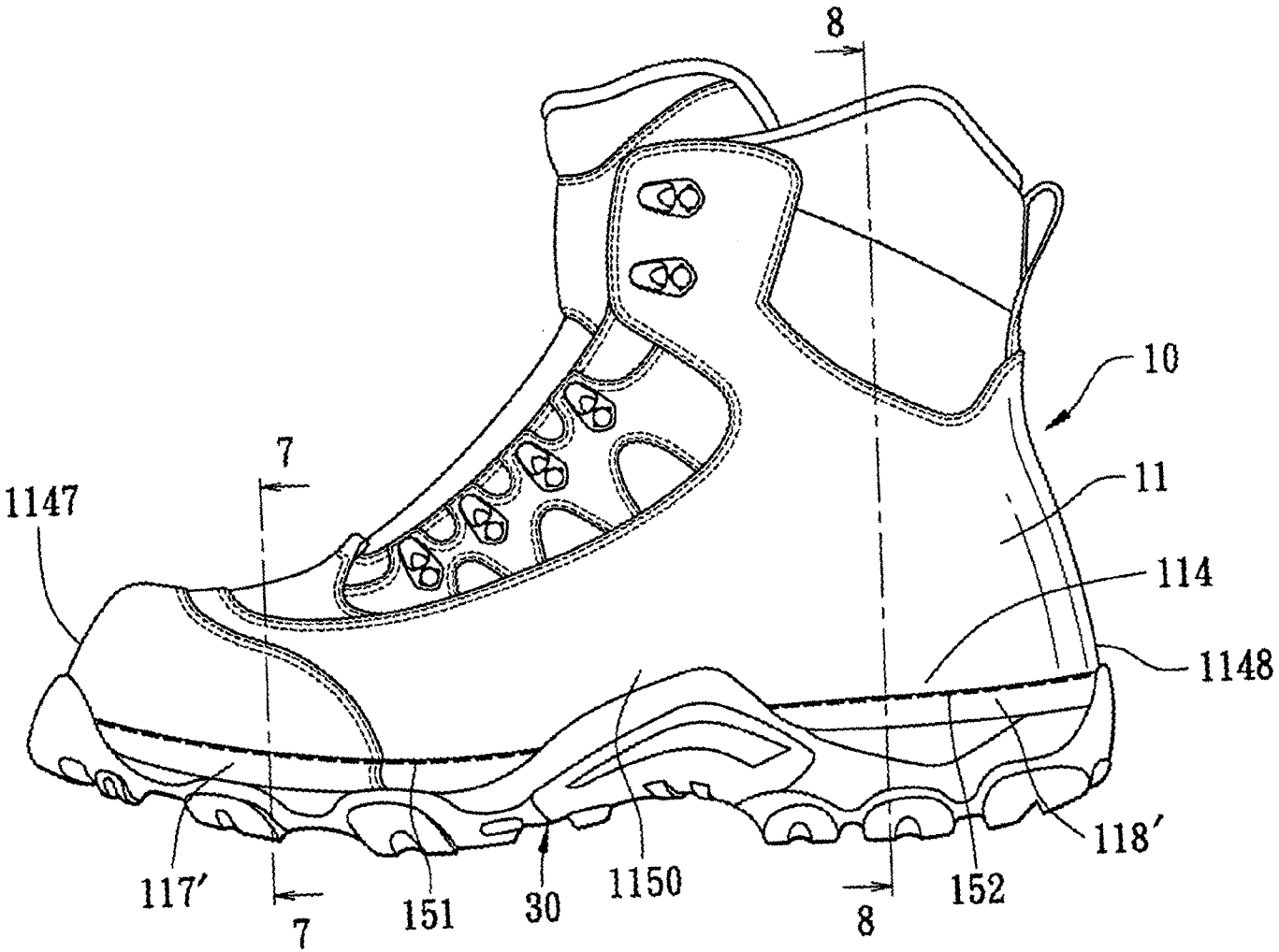
FIG. 6 is a side view of a third preferred embodiment of the present invention.
Figure 7:
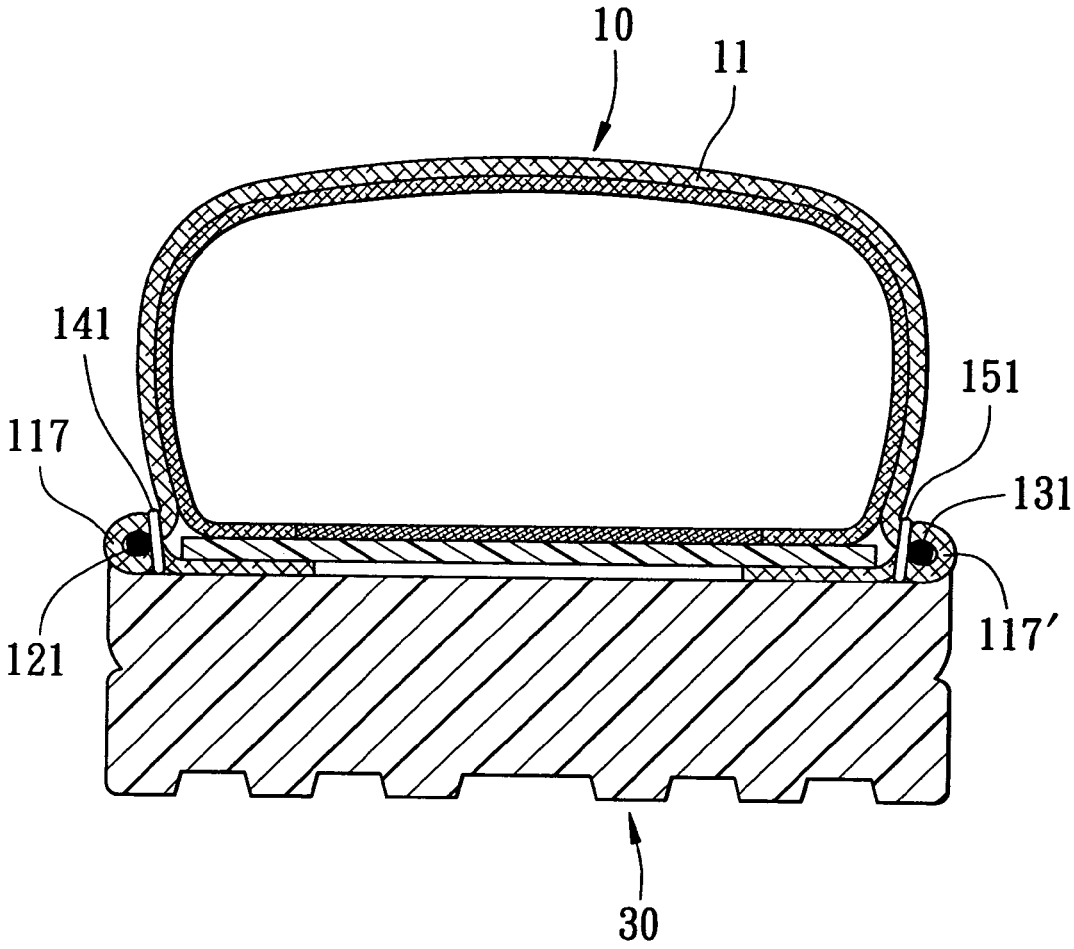
FIG. 7 is a sectional view taken along line 7—7 of FIG. 6.
Figure 8:
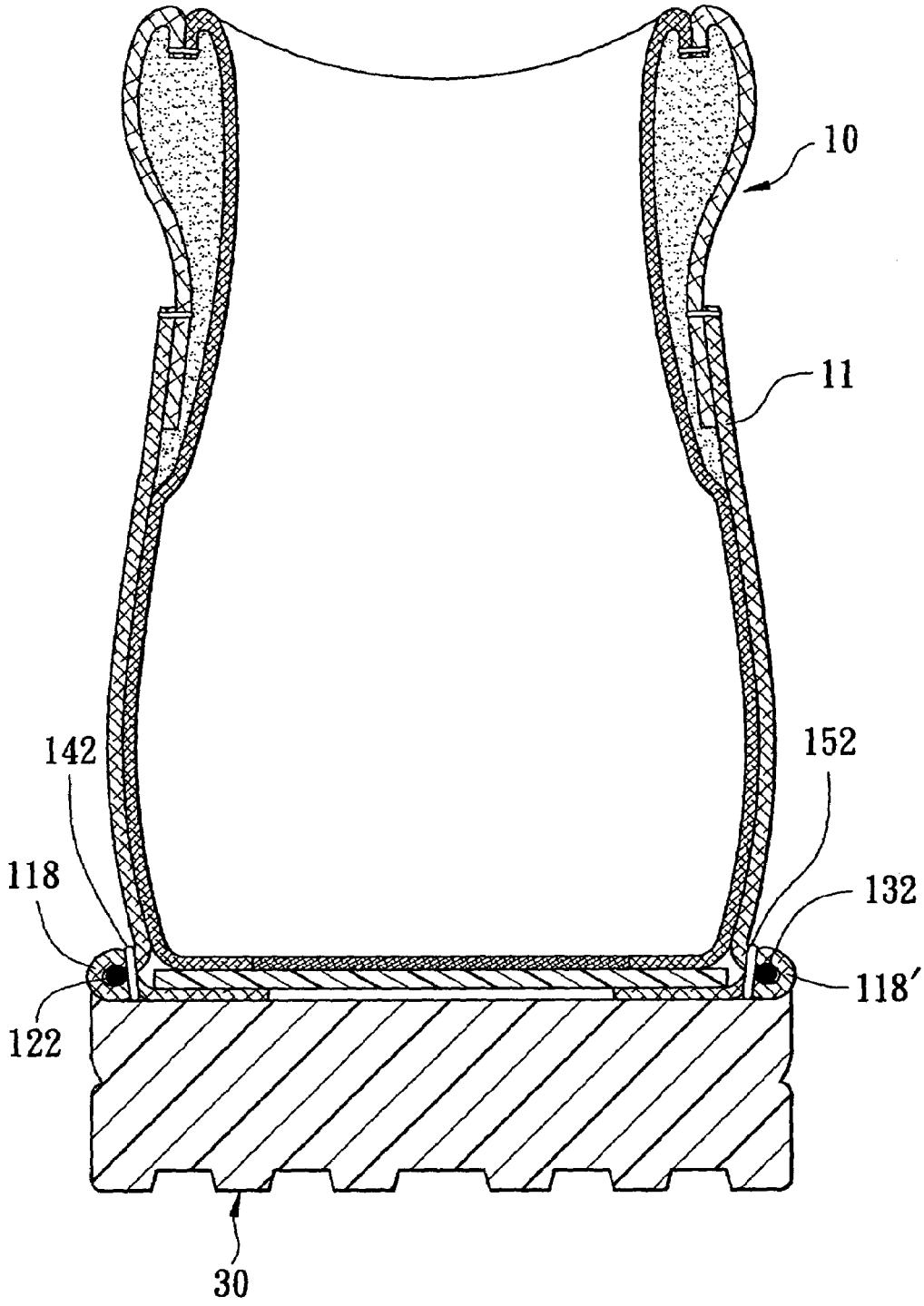
FIG. 8 is a sectional view taken along line 8—8 of FIG. 6.

Referring to FIGS. 6, 7 and 8, a third preferred embodiment of the present invention differs from the first embodiment in that the upper 11 thereof is provided with left and right front fold lines 117, 117' and left and right rear fold lines 118, 118'. The upper 11 has not any fold line at the front toe end 1147, the rear heel end 1148, and left and right shank parts (only a left shank part 1150 is shown in FIG. 6). Each of the left and right front fold lines 117 or 117' is separated from a corresponding one of the left and right rear fold lines 118 or 118' at the shank part 1150 of the upper 11. The left front fold line 117 is separated from the right front fold line 117' at the front toe end 1147, whereas the left rear fold line 118 is separated from the right rear fold line 118' at the rear heel end 1148.

The fold lines 117, 117', 118, 118' receive respectively interior strips 121, 131, 122, 132, and are provided respectively with sewing lines 141, 151, 142 and 152.

Figure 9:
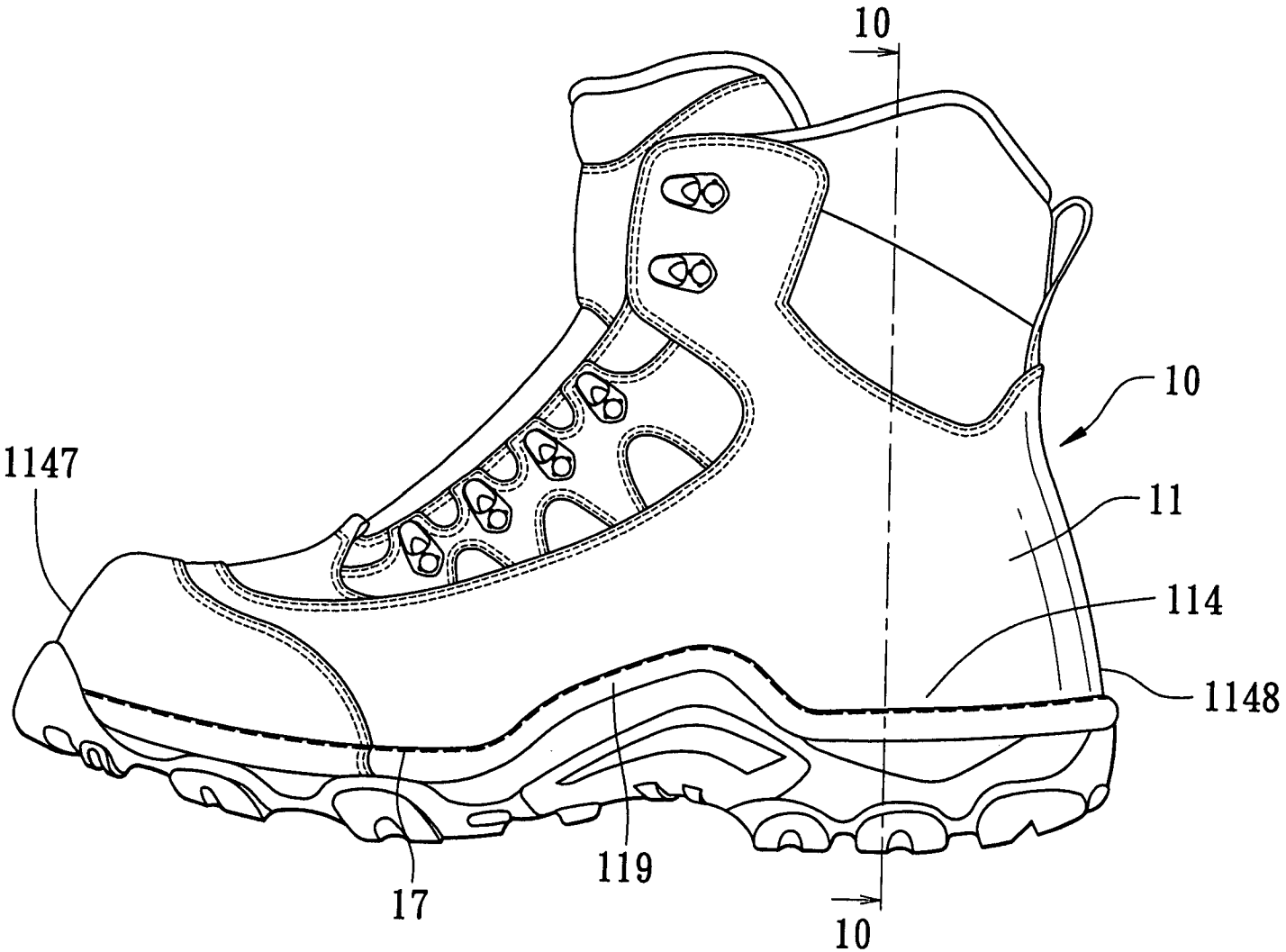
FIG. 9 is a side view of a fourth preferred embodiment of the present invention.
Figure 10:
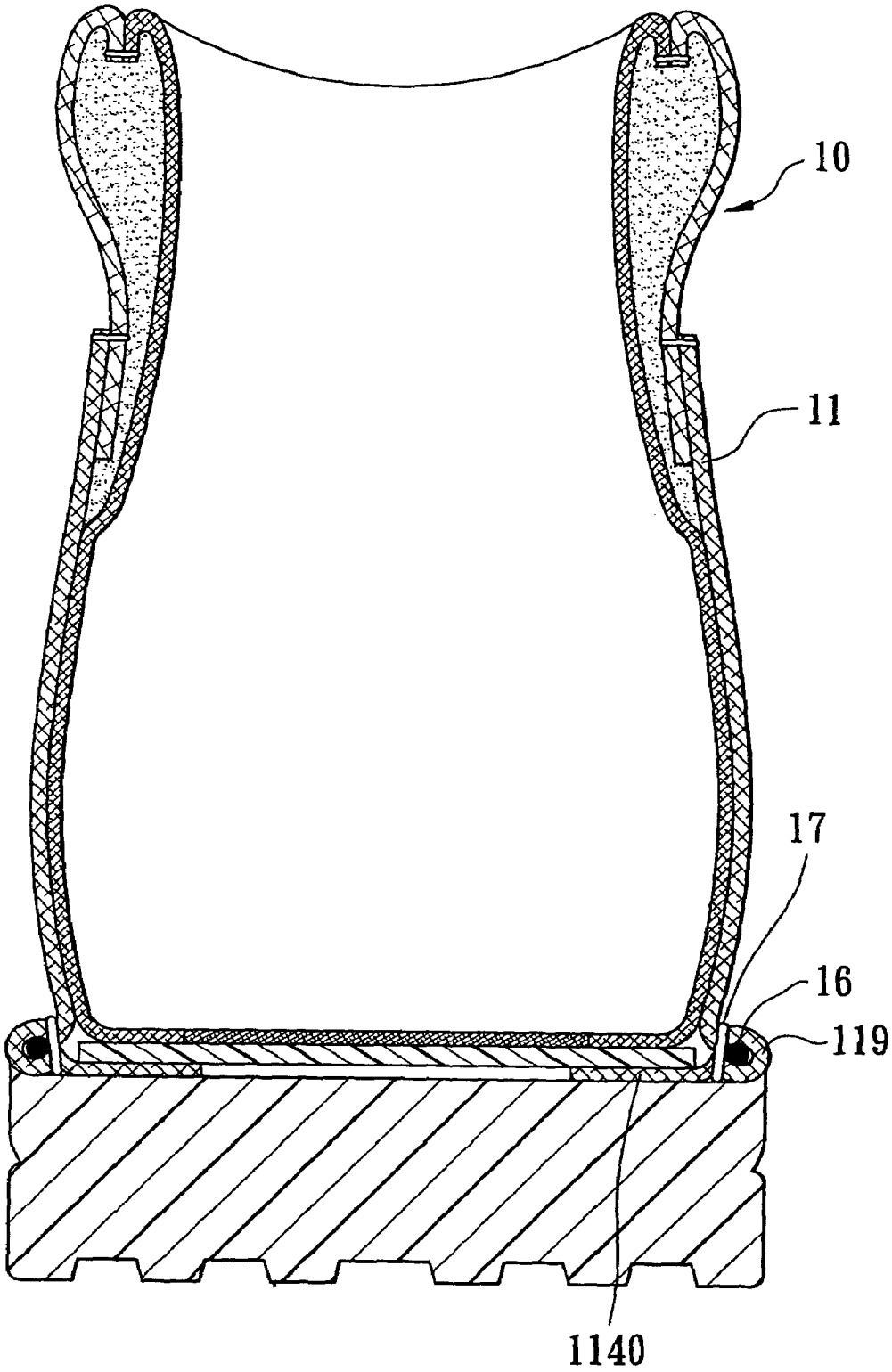
FIG. 10 is a sectional view taken along line 10—10 of FIG. 9.

Referring to FIGS. 9 and 10, a fourth preferred embodiment of the present invention differs from the first embodiment in that a single continuous fold line 119 is provided in the upper 11 of the fourth embodiment. The continuous fold line 119 extends continuously from the front toe end 1147 to the rear heel end 1148, and turns at the rear heel end 1148 to extend from the rear heel end 1148 to the front toe end 1147. The fold line 119 receives a single continuous strip 16 and has a continuous sewing line 17.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A shoe comprising:

an upper having an open top portion and an open bottom portion, said bottom portion having a front toe end and a rear heel end, said bottom portion being folded to form a welt-like fold line unit, said welt-like fold line unit including an outward turning part and an inward turning part, said fold line unit includes a plurality of fold lines which are separated from each other;

a sewing line unit extending through and fastening said outward and inward turning parts;

an interior strip unit extending along said fold line unit, said interior strip unit being received inside said fold line unit and retained therein by said sewing line unit;

an outsole connected to said upper, said outsole having a peripheral end which has a top face extending in the vicinity of said fold line unit; and an insole connected to said bottom portion of said upper, said insole having an outer edge which is separated and spaced part from said welt-like fold line unit, whereby no part of said insole is included in said welt-like fold line unit;

wherein said fold line unit includes left and right fold lines which extend between said front toe end and said rear heel end and which are separated from each other at said front toe end and said rear heel end.

2. The shoe as claimed in claim 1, wherein said bottom portion of said upper has a bottommost end which is lasted over said insole, said fold line unit being disposed at a level above said bottommost end, said top face of said peripheral end of said outsole being higher than said bottommost end of said upper.

3. The shoe as claimed in claim 1, wherein said bottom portion of said upper has a terminating end which is sewn directly to said outer edge of said insole, said bottom portion extending outwardly to a distance from said terminating end and thereafter forming said fold line unit outwardly of said terminating end.

4. The shoe as claimed in claim 1, wherein said interior strip unit includes two strips respectively received by said left and right fold lines, said sewing line unit including two sewing lines respectively extending through said left and right fold lines.

5. The shoe as claimed in claim 1, wherein said strips have different cross-sectional shapes.

6. The shoe as claimed in claim 1, wherein said strips have different stiffness properties.

7. A shoe comprising:

an upper having an open top portion and an open bottom portion, said bottom portion having a front toe end and a rear heel end, said bottom portion being folded to form a welt-like fold line unit, said welt-like fold line unit including an outward turning part and an inward turning part;

a sewing line unit extending through and fastening said outward and inward turning parts;

an interior strip unit extending along said fold line unit, said interior strip unit being received inside said fold line unit and retained therein by said sewing line unit;

an outsole connected to said upper, said outsole having a peripheral end which has a top face extending in the vicinity of said fold line unit; and an insole connected to said bottom portion of said upper, said insole having an outer edge which is separated and spaced part from said welt-like fold line unit, whereby no part of said insole is included in said welt-like fold line unit, wherein said interior strip unit includes a plurality of strips, and said strips have different cross-sectional shapes.

8. A shoe comprising:

an upper having an open top portion and an open bottom portion, said bottom portion having a front toe end and a rear heel end, said bottom portion being folded to form a welt-like fold line unit, said welt-like fold line unit including an outward turning part and an inward turning part;

a sewing line unit extending through and fastening said outward and inward turning parts;

an interior strip unit extending along said fold line unit, said interior strip unit being received inside said fold line unit and retained therein by said sewing line unit;

an outsole connected to said upper, said outsole having a peripheral end which has a top face extending in the vicinity of said fold line unit; and an insole connected to said bottom portion of said upper, said insole having an outer edge which is separated and spaced part from said welt-like fold line unit, whereby no part of said insole is included in said welt-like fold line unit, wherein said interior strip unit includes a plurality of strips, and said strips have different stiffness properties.

* * * * *